US011583735B2

(12) United States Patent
Chuang

(10) Patent No.: US 11,583,735 B2
(45) Date of Patent: Feb. 21, 2023

(54) BILLIARD BALL MADE WITH CONCENTRIC SEMI-TRANSPARENT/TRANSLUCENT SPHERES AND METHOD

(71) Applicant: William Chuang, Pittsburgh, PA (US)

(72) Inventor: William Chuang, Pittsburgh, PA (US)

( * ) Notice: Subject to any disclaimer, the term of this patent is extended or adjusted under 35 U.S.C. 154(b) by 0 days.

(21) Appl. No.: 16/909,600

(22) Filed: Jun. 23, 2020

(65) Prior Publication Data

US 2021/0316191 A1 Oct. 14, 2021

Related U.S. Application Data

(60) Provisional application No. 62/874,370, filed on Jul. 15, 2019.

(51) Int. Cl.

| | |
|---|---|
| ***A63B 37/00*** | (2006.01) |
| ***A63D 15/00*** | (2006.01) |
| ***A63B 43/00*** | (2006.01) |
| ***A63B 37/12*** | (2006.01) |
| ***A63B 37/04*** | (2006.01) |

(52) U.S. Cl.

CPC ..... *A63B 43/008* (2013.01); *A63B 37/04* (2013.01); *A63B 37/12* (2013.01); *A63D 15/006* (2013.01); *A63B 2243/002* (2013.01); *A63D 15/00* (2013.01)

(58) Field of Classification Search

CPC ..... A63B 2243/002; A63D 15/00; A63D 15/006; A63D 15/105

USPC ..... 473/52, 53

See application file for complete search history.

(56) References Cited

U.S. PATENT DOCUMENTS

| | | | | | |
|---|---|---|---|---|---|
| 77,823 | A * | 5/1868 | Linnincott | A63B 37/00 | 473/52 |
| 697,925 | A * | 4/1902 | Kempshall | A63B 37/00 | 473/52 |
| 724,470 | A * | 4/1903 | Haskell | A63B 37/00 | 473/52 |
| 753,392 | A * | 3/1904 | Haskell | A63B 37/00 | 473/52 |
| 979,397 | A * | 12/1910 | Burt | A63B 37/00 | 473/52 |
| 1,118,727 | A * | 11/1914 | Bibeault | A63B 37/00 | 473/52 |
| 1,339,992 | A * | 5/1920 | Wais | A63B 37/00 | 473/52 |
| 3,046,013 | A * | 7/1962 | Kutik | A63B 37/00 | 473/52 |
| 3,228,686 | A * | 1/1966 | Faulkner | A63B 37/00 | 473/52 |
| 3,947,026 | A * | 3/1976 | Scoutten | A63D 15/006 | 473/2 |

(Continued)

FOREIGN PATENT DOCUMENTS

| | | | | |
|---|---|---|---|---|
| CN | 106039694 A | * | 10/2016 | A63B 37/00 |
| GB | 2348149 A | * | 9/2000 | A63D 15/006 |
| KR | 2019001248 U | * | 5/2019 | A63B 37/00 |

*Primary Examiner* — Mitra Aryanpour

(74) *Attorney, Agent, or Firm* — Gary P. Topolosky

(57) ABSTRACT

A cue ball used for practice and play in pool or billiards. The cue ball is made with a plurality of concentric sphere layers or shells starting with a centermost opaque ball, followed by two or three spheres of differently colored semi-transparent polymer resins; then an outermost clear layer of polymer.

18 Claims, 11 Drawing Sheets

(56) References Cited

U.S. PATENT DOCUMENTS

| | | | | | |
|---|---|---|---|---|---|
| 3,958,804 | A * | 5/1976 | Godfrey | A63D 15/20 | 473/52 |
| 3,993,305 | A * | 11/1976 | Nicholson | A63B 37/00 | 473/2 |
| 4,116,439 | A * | 9/1978 | Chavarria | A63B 37/00 | 473/52 |
| 5,042,803 | A * | 8/1991 | Fox | A63B 43/04 | 473/53 |
| 5,322,475 | A * | 6/1994 | Irvin | A63D 15/006 | 473/52 |
| 6,364,783 | B1 * | 4/2002 | Kellogg, Jr. | A63D 15/006 | 473/2 |
| 6,866,590 | B2 * | 3/2005 | Tucker | A63B 37/14 | 473/2 |
| 8,523,693 | B2 * | 9/2013 | Nelson | A63D 15/006 | 473/2 |
| 2005/0064946 | A1 * | 3/2005 | Cianflone | A63B 37/00 | 473/52 |

* cited by examiner

BILLIARD BALL MADE WITH CONCENTRIC SEMI-TRANSPARENT/TRANSLUCENT SPHERES AND METHOD

CROSS-REFERENCE TO RELATED APPLICATIONS

This application is a perfection of U.S. Provisional Ser. No. 62/874,370, filed on Jul. 15, 2019, the disclosure of which is fully incorporated by reference herein.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

BACKGROUND OF THE INVENTION

(1) Field of the Invention

The present invention pertains to sports training equipment. More particularly, it relates to equipment and methods for improving billiards aiming and shooting skills.

Standard billiard games are normally played using fifteen (15) commonly sized, consecutively numbered balls and a slightly larger, slightly heavier cue ball. At the start of a game, the numbered balls are typically placed in an abutting relationship in a triangular shaped rack. A cue ball is then positioned at an opposite end of the billiard table at any location behind a marked spot. The cue ball is struck by the tip of a cue stick to propel it across the billiard table towards the un-racked, numbered balls for moving them to various locations, somewhat randomly about the tabletop. The typical width of a cue stick tip is about 12 or 13 mm. So, when talking about aiming one's cue stick for striking the cue ball towards a rack of balls (for the break) or for individual shots, players often talk about offsets, or aiming their cue stick at one or more "tips off center", roughly 12 to 24 mm away from the cue ball's physical center point.

At this point, the game of billiards progresses by using a cue stick to propel the cue ball towards an object ball for "sinking" one or more of the numbered object balls into a side or corner pocket on the billiard table.

The present invention relates to an improved system for aiming a billiard ball, preferably the cue ball, and striking it in preferred directions while playing billiards. Unlike some of the prior art practice cue balls, this invention can also be used in standard play as it will not require multiple axial ball rotations before shooting most every time. It allows the player to aim his or her stroke of the cue stick against the improved cue ball for effecting different ball motions including controlled speeds, spins, cuts, caroms, banks, deflections, draws, follows, squirts, stuns, natural rolls, center-ball english, throws, and other cue stick-to-ball phenomena. In other embodiments, this invention addresses an object ball made in the same, multi-spherical manner as described for the cue ball herein.

One of the most fascinating and often misunderstood aspects of pool is the relationship of physics to the geometry of the game. Most players tend to think of the interaction of the balls and rails as governed by a set of fixed geometric principles. This would be true if the motion of the balls had no spin, momentum, or acceleration components. Struck billiard balls still bounce, spin, and roll.

A ball may be considered to roll naturally when traveling the length of its circumference per revolution. In many instances, however, the ball cannot be characterized as rolling naturally. With a draw shot, for example, the cue ball is actually spinning backwards and skidding across the table into impact with the object ball. With other shots, the cue ball may be both rolling with topspin, and skidding, so as to travel the equivalent of two or three circumferences per revolution. It is known that some skidding will occur with all center ball or low hits, and, with an elevated cue stick, even on highball hits. A center ball hit at medium speed will have some skid before assuming a natural roll.

On a flush hit, a rolling ball will follow the object ball. On an angled hit, the cue ball will carom off at an angle, but also continue to roll forwards. Likewise, if the cue ball is skidding but spinning backwards when striking an object ball, the cue ball will back up on a flush hit, or deflect at a greater angle on a cut shot. If skidding without topspin or backspin when striking an object ball, the cue ball will deflect at a 90 degree angle off the object ball.

Although the physics of the game undeniably complicates predicting and understanding the effects of any particular shot, such complexity contributes to making billiards such a rich and enduring sport and a never-ending challenge for most players.

In pool or billiards, it is often advantageous to strike the cue ball with the chalked tip of a cue stick off the true center of the ball either high or low for a draw or follow, or to the left or right for left or right english to achieve a purposeful spin or backspin. The problem is trying to judge how far off center to hit the cue ball. This can be made more difficult when attempting to locate the true center of a cue ball that is all white and opaque.

At whatever level the game is played, it is necessary for a player to understand how the cue ball will behave when stroked and how the object balls behave when impacted by the cue ball. Given the complex interaction between geometry and physics, visual feedback from the balls is particularly important in conditioning the mind and body of the player to develop a sense of what will happen on any particular shot. The relatively high speed and spin of a struck cue ball make it difficult for many players to perceive anything but the crude results of each shot. This difficulty is intensified with respect to a standard, solid white cue ball that makes it almost impossible for a player to see the spin, slide, or roll of the ball, or to locate the center of the ball for aiming.

In view of the foregoing, it will be appreciated that practice systems and other aids for training how and where to strike a cue ball would be well received by players of all skill levels. A preferred system would be economic, easy to use and provide the player with immediate visual feedback as to the effect of each shot.

Solution: A cue ball (for both practice and standard play) made with multiple concentric spheres. Each of the outermost spheres is translucent so that one can see through the outer spheres to one or more of the inner spheres there beneath. This would allow the shooter to get an exact tip offset no matter what position the cue ball is in on the table.

(2) Description of Related Art Including Information Disclosed Under 37 CFR 1.97 and 1.98

This invention addresses an improved cue ball that is suitable for both practice and regular/standard play. There are known practice cue balls made and sold but they share a common feature, i.e., hemispherical markings which require performing some axial rotation (or spinning) to properly align the cue ball before striking it with a cue stick tip. Applicant's improved cue ball requires no such repeated axial rotations; it can be struck from any angle as its markings will be visible regardless how the cue ball sits after the preceding "shot".

FIGS. 1A and B are front plan views showing one prior art, Jim Rempe pool training ball. It has a simpler side (FIG. 1A) with targeted markings for high and low, left and right strikes and several intermediate points. The same practice ball also shows a more advanced hemisphere (side), FIG. 1B, with numerical calibrations for more advanced players.

FIG. 2 is a front plan view showing a prior art, a 2.25 inch diameter, standard size practice cue ball as made and sold online by Shangup and/or Injoyo. Note that it displays in its hemisphere a plurality of hollow markings HM extending outwardly from a central dot CD in eight, equally spaced apart directions that mimic the main points of a compass, north, east, south and west and the four directions between adjoining regions.

FIG. 3 is a front plan view of another prior art practice cue ball, similar to that of FIG. 2 but with a pattern of solid (filled in) markings SM, as made and sold online by Cuesoul.

FIG. 4 shows a front plan view of another prior art practice cue ball made and sold online by Aramith under the name Pool Champion. It shows one central cross hatch (or plus sign PS), with just a pair of left extending AND right extending, horizontal dashes HD. It has no vertically extending equivalents.

In FIG. 5, yet another prior art practice cue ball, made and sold online by Aramith under the name Q-Tru Training Cue Ball, is depicted. It also contains a central dot CD, about which is situated clockwise markings CM at 12 o'clock, 3 o'clock, 6 o'clock and 9 o'clock with intermediate dashes ID between the four main markings.

Still other prior art includes "Measle Balls" which are solid white cue balls with a plurality of red dots about their perimeters for allowing the shooter to better gauge the "spin" of his/her shot. There is also the practice cue balls disclosed in U.S. Pat. Nos. 5,716,283 and 6,364,783.

Numerous manufacturers of clear billiard ball sets are known. They include versions made and sold online by Rocco, Hobbit and Epco among others. Many are made from acrylic polymers. Still other companies make and sell customized, clear ball sets. But none of these "prior art clear billiard ball sets include the multiple shelled, spherical systems of this invention, such layered sphere systems (or shell-within-a-shell) serving to aid in the aiming/targeting of where to strike billiard balls with a multi-layered cue ball also made according to this invention.

BRIEF SUMMARY OF THE INVENTION

As stated above, for a cue ball used in pool and/or billiards, it is often advantageous to hit (or shoot) the cue ball off the center of said cue ball: either high or low for a draw or follow, or to the left or right for left or right english (spin). The problem is judging how far off center to hit the ball. The nomenclature is usually one or two tips off the center of the ball, but how far is that? In fact, it can be quite difficult to approximate the center of a standard unmarked, solid white cue ball as it rests on the pool tabletop. The present invention solves that problem.

The main problem with known practice or training cue balls marked with a plurality of lines is to delineate a true ball center from one visual hemisphere along with multiple quadrants from that hemispherically-driven center point, i.e., high right, low left, etc. To best figure that out, all of the foregoing prior art practice cue balls must be "set up" in a particular way (i.e., direction, rotation) for proper usage. With the Rempe practice ball, for instance, the circles on the face of the cue ball hemisphere must be facing the shooter/user square. They cannot be tilted or angled. This is quite difficult to do. It is also quite annoying as the ball must be reset in a specific way before almost every shot/hit.

The foregoing matters relating to the aiming, contacting, roundness perceptions and interactions between the cue ball and object ball(s) make it difficult for players of all skill levels to master the game of pool because of the difficulty in determining: (a) the geometric positioning of the cue ball "aiming point" to the "contact point" of the object ball; and/or (b) the related effects of physics on the stroke of the cue ball and the consequences of its impact with the object ball. A cue ball practice system that would provide visual and direct reference of the "aiming point" of the cue ball, the "contact point" of the object ball, horizontal roundness of the object ball and the effects of each particular shot would be beneficial to players of all skill levels.

The present invention addresses a training system for the playing of pool and pocket billiards that utilizes a cue ball (practice or otherwise) that provides visual indicia to the player on how to better aim and effect the stroke on the motion of the balls. In combining improved sighting and alignment capabilities with immediate visual feedback, the system allows the player to: select a proper aiming point; and discern immediately how close his/her actual stroke needs to come to that selected aiming point. After the stroke, the indicia provided assists the player in understanding the effect of the stroke on the ultimate motion of the balls. By following a training regime with exercises designed to exploit the capabilities of the practice ball system of the present invention, a player may improve his or her aiming techniques and also learn how to better stroke the cue ball for achieving such effects as spin, stun, follow, and draw.

It is therefore a feature of the present invention to provide a cue ball for training in the playing of pool or pocket billiards. The cue ball has a generally spherical outer surface extending about an axis of revolution circumscribed by a central meridian and is movable along a playing surface from impact by a cue stick having a chalk-coated tip.

The invention comprises a cue ball apparatus, and a related method of use, that are exemplified in the following detailed description. Reference to that description and to the accompanying drawings should be had for a fuller understanding and appreciation of the nature and objects of the invention, although other objects may be obvious to those skilled in the art.

Accordingly, the present invention is directed to: a multi-layered, semi-transparent cue ball for use in the game of pool or pocket billiards; and to a method of using that cue ball in practice or regular play. Seeing through the outermost layers, a player can better aim his or her preferred contact or aiming point for attempting to achieve the desired cue ball-object ball striking effect. All of this can be accomplished without having to rotate the cue ball, most every time, to see duly aligned, particular markings as is the case with prior art practice cue balls. By following a training routine with exercises designed to take advantage of the capabilities of the practice system in accordance with the present invention, players may improve their alignment, aiming and shooting abilities.

Accordingly, an object of the present invention is the provision of a translucent cue ball system and method of aiming for the playing of pool and pocket billiards.

Another object is the provision of a pocket billiard cue ball that enables its shooter to determine the correct "aiming point" on the cue ball with a desired "contact point" on the object ball and the imaginary line therebetween.

Still another object is to provide a targeting cue ball that will not require repeated rotational re-positioning between shots unlike the known prior art collection of practice balls shown and described herein.

The solution of this invention is to provide a regulation size, cue ball made with concentric spheres. Each sphere is translucent so that the shooter/user can readily see the respective inner spheres underneath. For example, a first embodiment of this invention would include a dark or black center sphere having a diameter of about 10 mm. It could be made from lead, or otherwise weighted to giving the cue ball its proper overall weight.

The next sphere would be a translucent red or semi-transparent layer with a red tint. It would surround the center black sphere and provide an overall outer diameter dimension of about 12 mm. After that would follow a green spherical layer—also transparent/translucent. When it surrounds the second innermost red cue ball layer, it would extend the third ball's outer diameter to about 13 mm.

The final concentric sphere, surrounding the green and red layers, respectively, would be totally clear while bringing the ball to the exact diameter needed for a standard size, regulation cue ball that measures roughly 56 or 57 mm across. With preferably four overlapping, surrounding layers, this invention will allow a shooter/user to better gauge an exact tip offset no matter what resting (i.e., after shot) position the cue ball is in.

The version of the invention disclosed/discussed herein—A cue ball made of several concentric layers of clear (translucent OR semi-transparent) plastic. Each layer is a different color and of a defined thickness to indicate offset form the center of the cue ball.

BRIEF DESCRIPTION OF THE DRAWINGS

Other advantages and novel features of the present invention will become apparent in the following detailed description of the invention when considered in conjunction with the accompanying drawings.

DESCRIPTION OF PREFERRED EMBODIMENTS

Figure 1A:
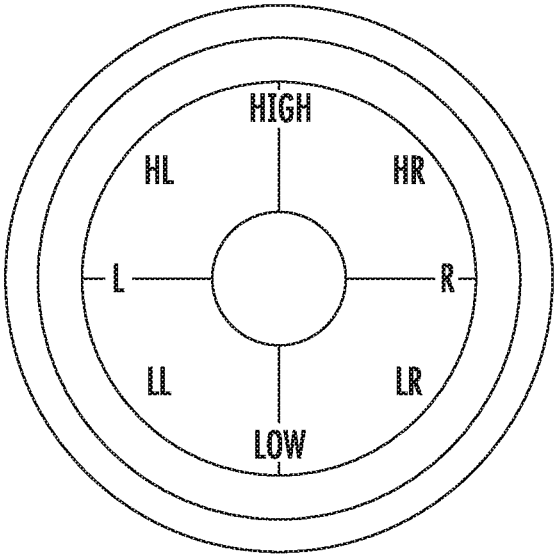
FIG. 1A (PRIOR ART)
FIG. 1A is a front plan view showing a prior art, Jim Rempe pool training ball, in its packaging, said practice ball having a less complicated beginner's side hemisphere.
Figure 1B:
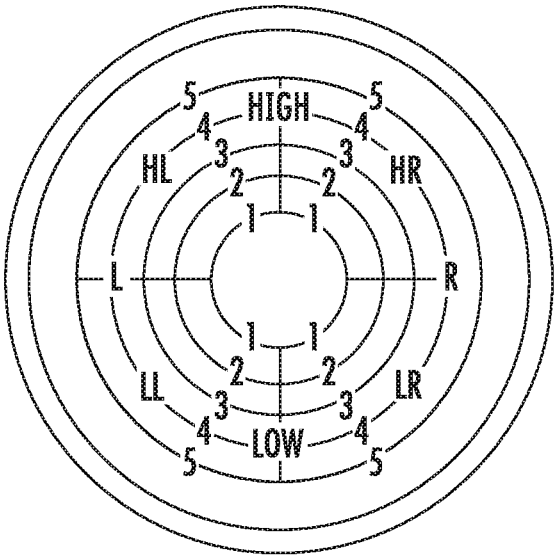
FIG. 1B (PRIOR ART)
FIG. 1B is a front plan view showing the opposite to the beginner's hemisphere in FIG. 1A, this side showing a more complicated, advanced player's hemisphere.
Figure 2:
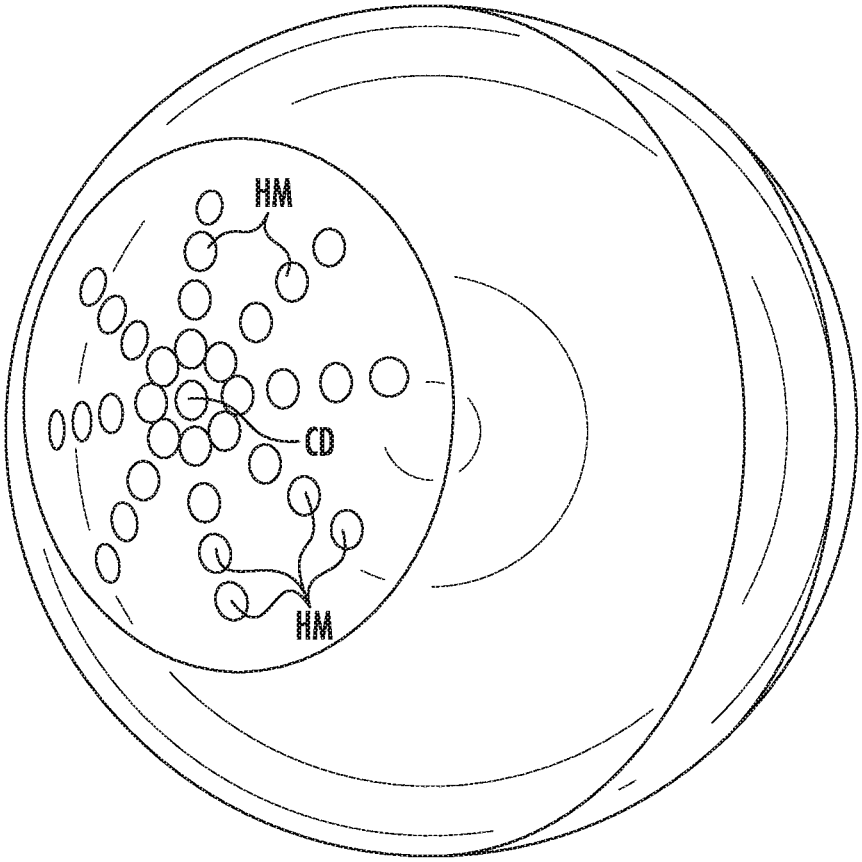
FIG. 2 (PRIOR ART)
FIG. 2 is a front plan view showing a prior art, 57 mm (2.25 inch) diameter practice cue ball as made and sold online by Shangup and/or Injoyo.
Figure 3:
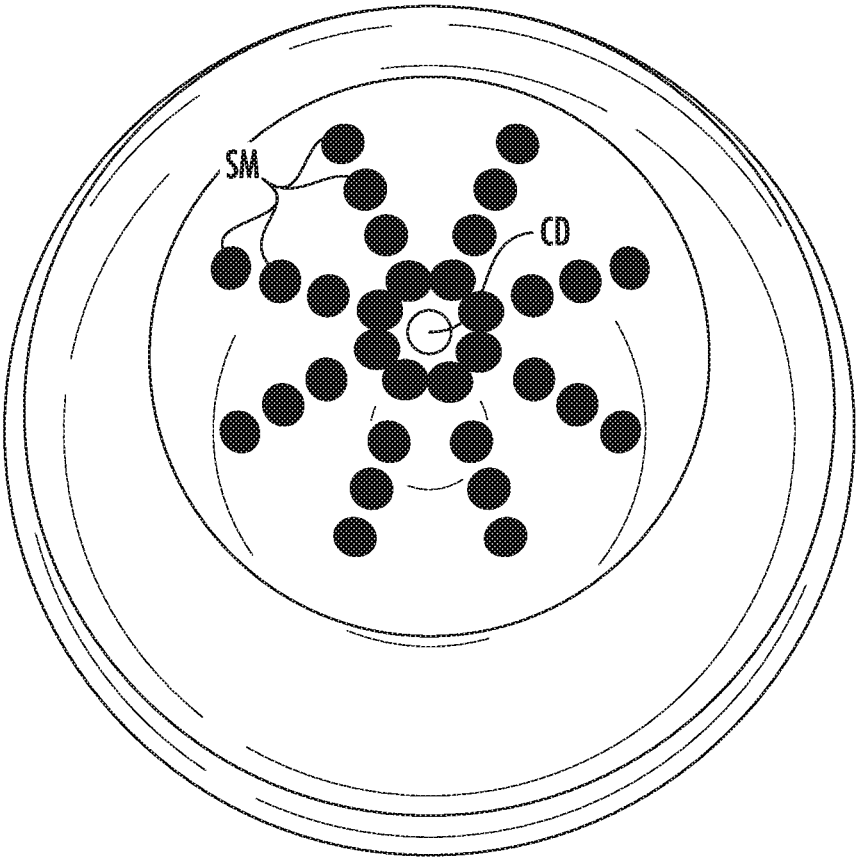
FIG. 3 (PRIOR ART)
FIG. 3 is a front plan view showing a prior art, practice cue ball, similar to that of FIG. 2 but with a pattern of solid (filled in) dots, as made and sold online by Cuesoul.
Figure 4:
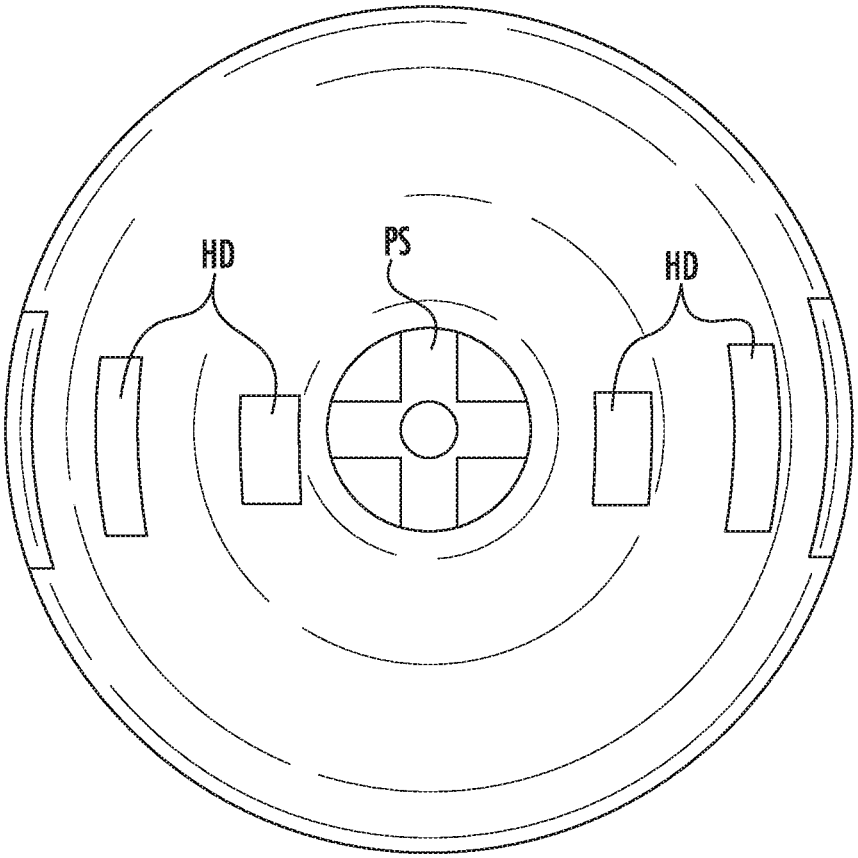
FIG. 4 (PRIOR ART)
FIG. 4 is a front plan view of yet another prior art, practice cue ball made and sold online by Aramith under the name Pool Champion.
Figure 5:
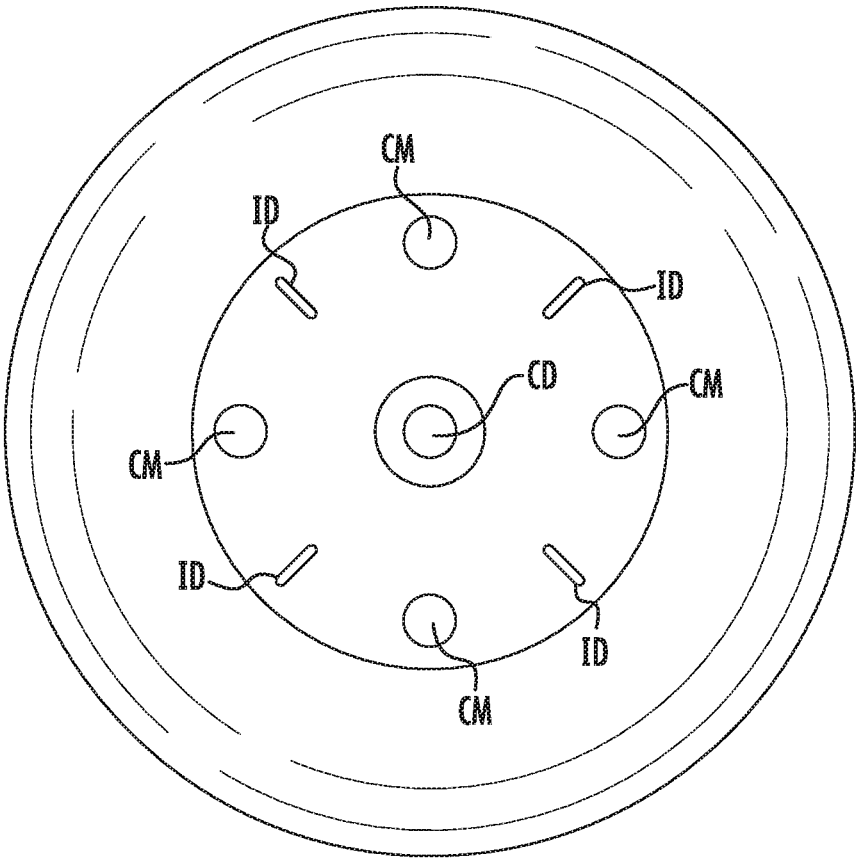
FIG. 5 (PRIOR ART)
FIG. 5 is a front plan view of yet another prior art, practice cue ball made and sold online by Aramith under the name Q-Tru Training Cue Ball.

One of the most misunderstood and difficult aspects of the game of pool is to discern the geometric linear relationship between the cue ball and the object ball. It is well known that an object ball will travel along a straight line originating at the point where the cue ball contacts the object ball and extending through the center of the object ball. There is also a relationship of physics to the geometry of the game of pool. Accordingly, the game of pool is a game of both physics and geometry. Since the object ball travels in a straight line, players of pockets billiards typically picture an imaginary line from the center of a pocket on the billiard table through the center of the object ball. The termination of this imaginary line establishes a point where the cue ball should contact the object ball to propel the object ball into the pocket on the billiard table. This is commonly referred to as the "contact point." It makes no difference where the balls are located on the billiard table, as long as the cue ball makes good contact at the "contact point" on the object ball, the object ball will travel along the imaginary line. In reaching the "contact point" on the object ball, however, the cue ball does not necessarily travel in a straight line, nor does it have to roll naturally. The cue ball may be rolling naturally when it travels the length of its circumference with each revolution of the ball. The physics of may be applied to the cue ball as a result of a given stroke and tip placement with the cue stick. The physics of spin complicates the game of pool and contributes to the complexity of predicting and understanding the effects on the cue ball of any given shot.

Aiming the cue ball so it strikes the termination point of the imaginary line, which is the contact point of the imaginary line that bisects the object ball and the pocket of choice, is difficult because the shooter cannot easily discern the point of contact on the object ball. It is also difficult for the shooter to discern the point on the cue ball commonly referred to as the "aiming point," which should normally be used for both aligning the aim and impacting the contact point, when the shooter is positioned behind the cue ball.

In the past, cue balls were made from a variety of materials including elephant ivory. Most standard sized, solid white cue balls today are made from a phenolic resin that is cast, hardened, sanded and then polished. When finished, it should weigh about 0.17 kg (6 oz.) as compared to the smaller object balls, often numbered 1 to 15, with solids or stripes, weighing 0.16 kg (or 5.5 oz) each.

Relationship between the components—There is only one major component to the apparatus of this invention. It is the cue ball itself, a regulation size cue ball made from different concentric layers—of transparent or semi-transparent colored plastic(s) all of which surround an innermost opaque, cue ball center.

How the invention works—each of the concentric colored layers indicates a certain degree of offset form the center of the ball to let the pool shooter know where to hit the ball in order to get the right spin on the ball, i.e., english, draw or follow.

How to make the invention—Make a sphere out of clear plastic or resin. That centermost sphere is then cast it into the center of a larger, intermediate sphere made from a first different color of translucent plastic/resin. Do this a third time to make three (or more) colored layers. Then the final layer will be made of a clear resin/plastic for emulating the size/shape of a standard cue ball.

The relative size and number of colored layers may vary.

Ideally, these semi-transparent color layers can be customized AND alternated.

How to use the invention—Use this new multi-layered, concentric ball for getting a consistent draw, follow or english on the shot.

Figure 6:
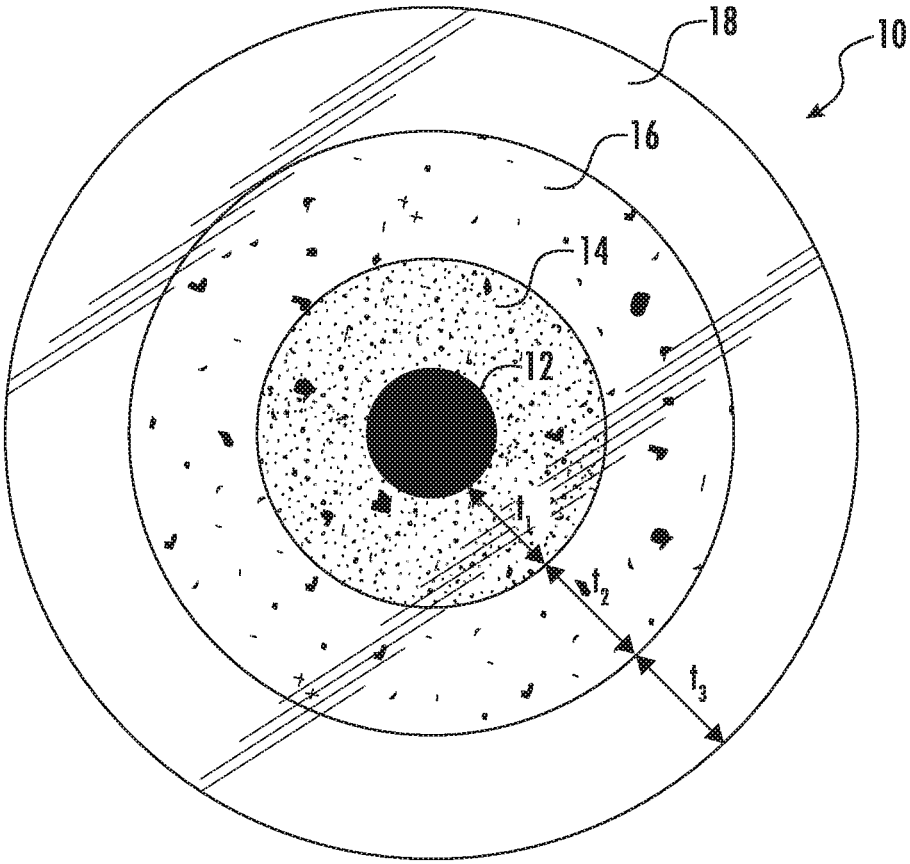
FIG. 6 is a front plan view of one embodiment of semi-transparent/translucent cue ball per the present invention, said cue ball having four representative spherical layers.
Figure 7:
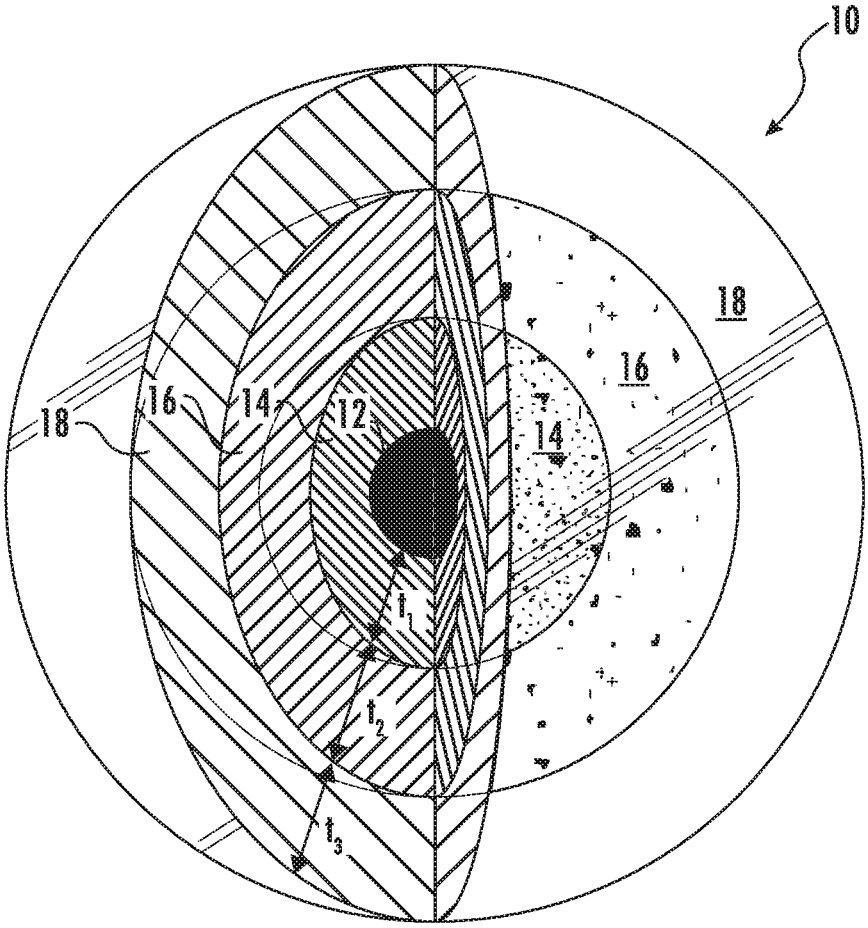
FIG. 7 is a partial sectional view of the cue ball from FIG. 6 taken as if a north-to-south wedge of orange slice was removed therefrom.

In accompanying FIGS. 6 and 7, there is shown one preferred embodiment of this invention. Therein, billiard ball, generally 10, consists of a first innermost spherical layer 12. It should be made to be opaque so as to be visible THROUGH all subsequent cue ball layers surrounding it. Considering the relative weights of all surrounding layers, this centermost sphere 12 may be the preferred means for providing the billiard ball with most of its necessary regulation "weight". As such, one version of centermost layer 12 is made from lead or another similar "heavy", opaque material. Preferably, the opaque material is black though other dark colors including brown, dark blue and purple may be optional alternatives.

Immediately surrounding centermost sphere 12 of billiard ball 10 is a first semi-transparent ball or sphere 14. Made from a polymer so as to be clearly visible therethrough, one version of first inner sphere 14 is supplied with a slightly red tint (though it is to be understood that still other semi-transparent color layers may be substituted therefor). In one sense, this innermost red sphere provides the shooter with a target aim equivalent to one tip (or "click") away from the center point (or black sphere 12) of this new, improved billiard ball configuration.

In one preferred embodiment of billiard ball 10, the width of innermost red band 14 is 10 to 13 mm, preferably about 11 millimeters in diameter (or roughly 0.043 inches across).

Next, after the center sphere 12 and inner red sphere 14, there is provided a fully surrounding second intermediate sphere 16. In one version, this translucent layer is made with a slight green tint so that the adjacent red inner layer 14, AND the innermost central black layer 12 can be easily discerned therethrough. Also made from a polymer, second green sphere layer 16 ideally measures about 12 mm across.

Ideally, the various layers of this billiard ball (either cue ball or object ball) should be kept fairly consistent in overall thicknesses meaning that a center ball with two intermediate layers might have preferred thickness layers $t_1$, $t_2$ and $t_3$, of about 12-13 mm each—or roughly the approximate equivalent of a cue stick tip (also about 12 mm across). For the lesser layered version of billiard ball at FIG. 8, layers $\mathbf{3}t_1$ and $\mathbf{3}t_3$, would be correspondingly "thicker", maybe as much as 16-18 mm each. Conversely, the more layered version of FIG. 9 would have to be slightly smaller to accommodate another intermediate layer of yet another semi-transparent material (possibly yellow-tinted or the like). In that 5 tiered variation (counting the center ball as the first "tier"), these supplemental layers $\mathbf{5}t_1$, $\mathbf{5}t_2$, $\mathbf{5}t_3$ and $\mathbf{5}t_4$, preferably commonly sized, might be closer to about 9-12 mm thick each (depending on the overall size of center ball diameter used). In one embodiment, there would be included a centermost spherical ball between 11 to 16 mm in diameter; followed by a first interior shell layer between 11 to 13 mm thick (total diameter between 22 to 29 mm); a second shell layer between 11 to 13 mm thick (total diameter between 33 to 42 mm); and an outermost shell layer between 11 to 15 mm thick (for a total diameter between 44 to 57 mm).

Also note that with respect to the various, aforesaid shell layer dimensions, the thicknesses described refer to the "visualized thickness". Because the balls are each made from a plurality of transparent (or semi-transparent) sphere shells, there is magnification of each layer by each successive shell layer. The "visualized thickness" is that which can be measured if one took a life size picture of this ball so that the diameter of the ball in the picture is the same as the diameter of an actual cue ball. The thicknesses of each layer can then be acquired from this picture by simply measuring with a ruler.

When lesser layers are preferred/needed, a billiard ball can be made and sold, as either a cue ball, an object ball or both, with just a central spherical ball surrounded by just one interior layer of semi-transparent material followed by an outermost clear polymer exterior layer as per accompanying FIG. 8, described below. When still greater distinct layering is desired, second green sphere may be optionally surrounded with a third spherical surround, preferably yellow in tint as per FIG. 9, described below.

Lastly, the outermost layer, or true exterior to cue ball 10 is provided in a totally clear surround of polymer. This outermost exterior sphere (or shell 18) should be the balance of the shell body to cue ball 10. It should measure about 57 mm across if split directly in half.

In the alternate variations of the main embodiment, common elements are commonly numbered though in the next hundred series.

Figure 8:
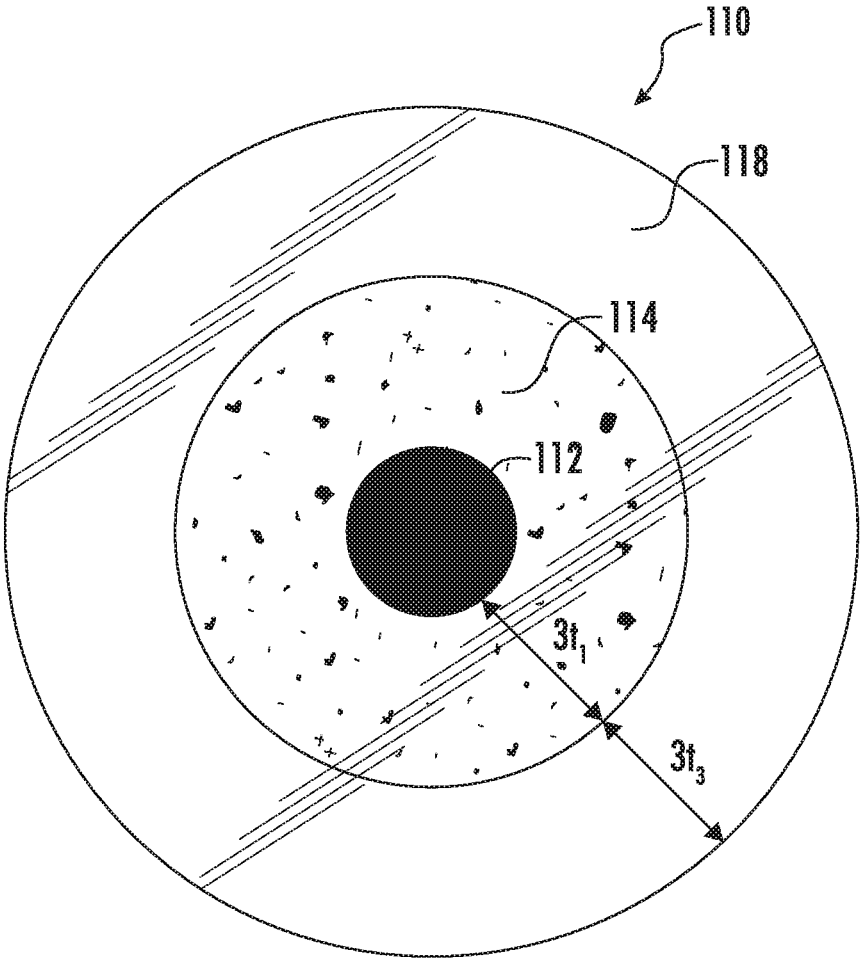
FIG. 8 is a first variation to the billiard ball shown in FIG. 6 but with only center area and two outer spheres (rather than the 3 full spheres of FIG. 6.

Referring now to FIG. 8, there is shown a first variation of billiard ball 110 comprised on one centermost sphere 112 about which a first layer 114 of tinted polymer is provided/installed followed by just one other layer, the outermost clear polymer layer 118. Because this variation is only 3 "spheres" deep, the varying layer thicknesses are greater than would be the case with a four or greater "sphere" thickness model.

Figure 9:
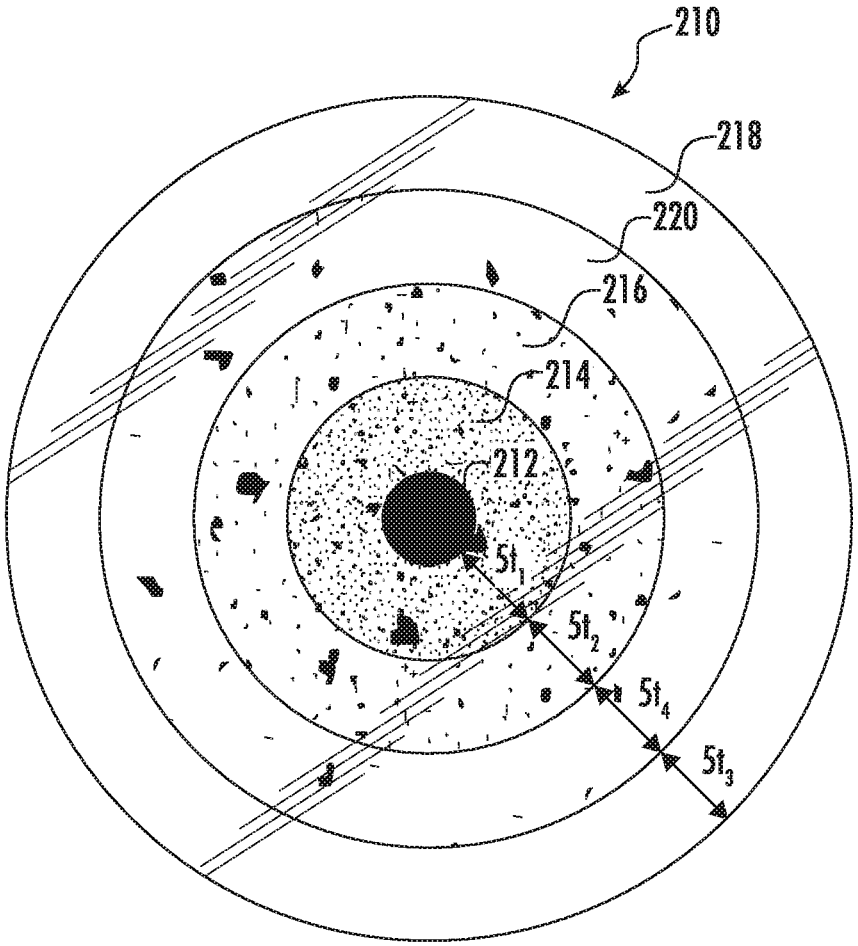
FIG. 9 is a second variation of billiard ball but with FOUR outer layers around a darkened center sphere, one more than the version depicted in FIG. 6.

In FIG. 9, there is shown a second variation of billiard ball 210 comprised on one centermost sphere 212 about which a first layer 214 of tinted polymer is provided/installed followed by a first intermediate, differently tinted layer 216, then a second, differently tinted intermediate layer 220 before the whole is encased in its outermost clear polymer layer 218. Because this variation is 5 "spheres" deep, the varying layer thicknesses are smaller than would be the case with a three or four "sphere" thickness model.

When one has more than four spherical layers, it is conceivable though not preferred to possibly repeat tint colors so that a red-green-red set of shells around the centermost black sphere could be made and sold hereunder.

Figure 10A:
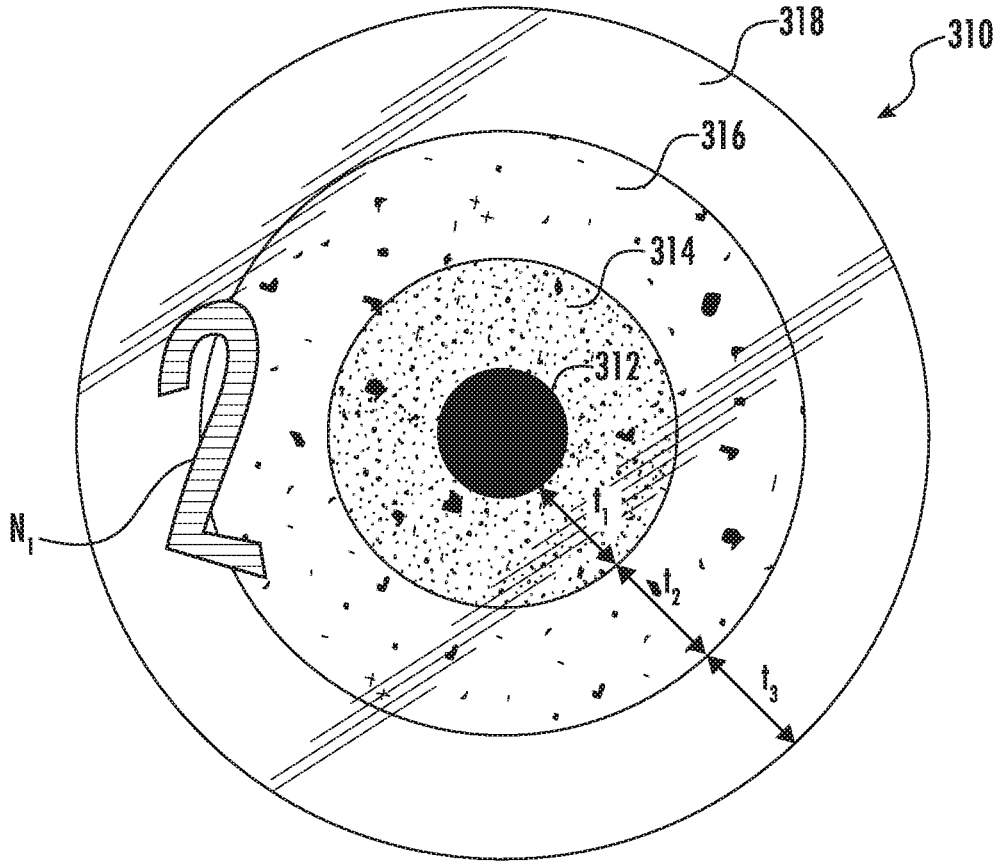
FIG. 10A is a front view of a third variation of billiard ball having a ball number added thereto, said ball number being a representative No. 2 ball in blue.
Figure 10B:
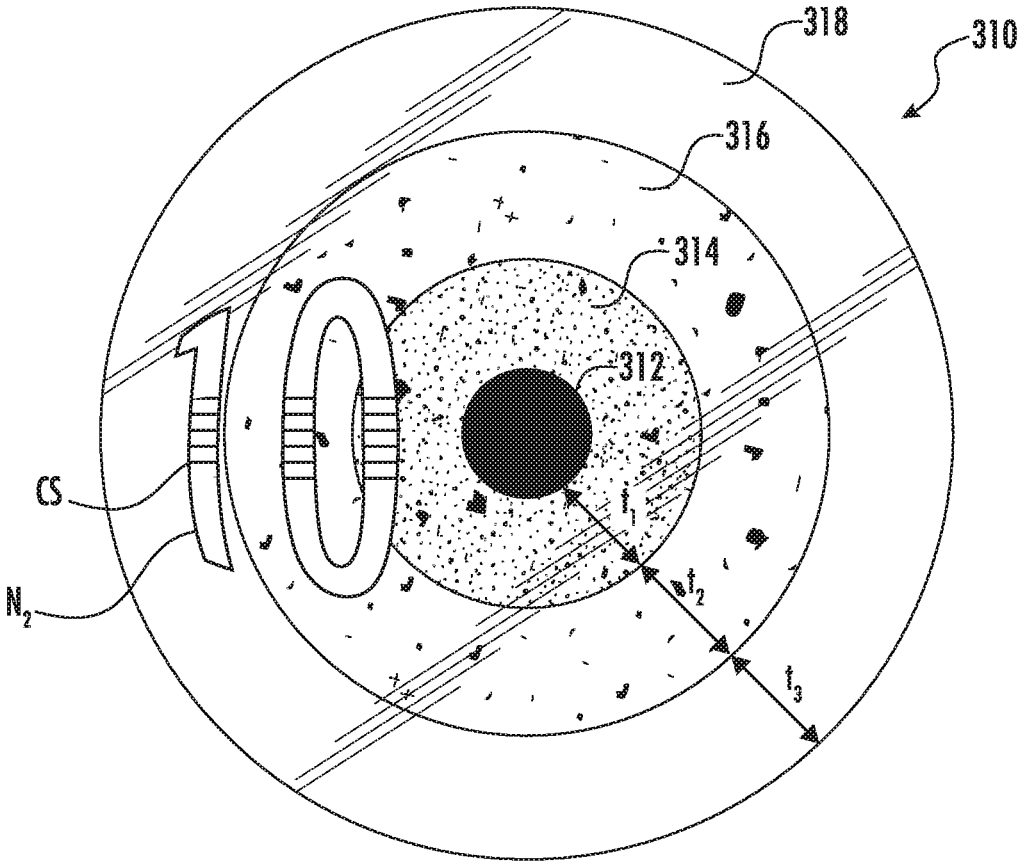
FIG. 10B is a front view of the third variation of billiard ball as per FIG. 10A, this variation including a representative No. 10 ball in white with a horizontal blue stripe through its center section CS.

FIGS. 10A and B show representative examples of billiard balls that can be provided with ball numbers, item $N_1$ in FIG. 10A and $N_2$ in FIG. 10B. Note that the number 10 ball of FIG. 10B also included a representative central stripe section CS as many billiard ball sets follow industry guidelines in dividing the "colored" balls into solids, numbered 1 through 8, and stripes, numbered 9 through 15.

There is also a well understood/accepted practice of common numbered ball coloring. Specifically, there are 3 primary-colored balls in each number "set", i.e. the lower numbered balls 1 through 7, and the higher numbered balls 9 through 15. Balls 1 and 9 are colored yellow; balls 2 and 10, blue with balls 3 and 11, in red. Next, there are three sets of secondary colored balls: 4 and 12 being purple (a combination of red and blue); balls 5 and 13 being orange (a combination of red and yellow) and balls 6 and 14 being green (a combination of yellow and blue). There is also one established tertiary color selection: balls 7 and 15 are maroon colored (sometimes mistaken for brown). That color is a combination of purple with red. Lastly, there is the consistently black, no. 8 ball and the usually white cue ball . . . until THIS invention!

The examples that follow are illustrative of exercises that may be included in training regime designed to exploit the capabilities of the present invention. By following such a regime, a player may improve his or her aiming techniques, and also learn how to stroke the cue ball to achieve such effects as spin, stun, follow, and draw. These examples, however, are only illustrative of the precepts of the present invention, and therefore should not be construed in any limiting sense.

In addition to its use as a cue ball, this invention can be used to make a plurality of billiard balls for use as object balls. An object ball is the initially ball struck by the cue ball. There are various aiming methods to choose a target point on the object ball to strike with the cue ball. All aiming methods rely on identification of the edge of the object ball. Because the object ball is a solid sphere, this is the only site on an object ball that can be clearly identified. All other points can only be estimated. If one is able to aim and hit the edge of the object ball with the cue ball, that is called a "half ball" hit. Half ball refers to the amount of the object ball that is covered, or hidden by the cue ball, when viewing the object ball from the cue ball. The physics of this type of hit, in terms of cue ball and object ball io reactions, have been well worked out. It is very helpful to be able to execute a half ball hit knowing how the balls will react.

An aiming method called "fractional aiming" takes this one step further. This method attempts to identify other points on the objects ball, and thus take advantage of the known reactions of the balls for these types of hits. For example, in a "three-quarter ball" hit, one attempts to strike the object ball with the cue ball at a point half way between the center and the edge of the object ball. Clearly, this point can only be estimated/approximated because there is no marking on the object ball to delineate any such point. With the present invention, however, using a ball with multiple concentric spheres, both the center of the ball and the point half way between the center and the edge can be clearly delineated. Object balls according to this invention would be ideally used for training the eye to recognize this optimum point to successfully execute a three-quarter ball hit.

Depending on the number of concentric spheres used, any fraction between 1 (known as a full ball hit) and ½ (half ball hit) can theoretically be reached. At times, it may be necessary to aim the center of the cue ball at a target beyond the edge of the cue ball. These are described as "thin" cuts, as opposed to "thick" cuts where the shooter attempts to hit more of the object ball. For example, in a quarter ball hit, one attempts to aim the cue ball at a point outside the edge of the object ball that is equidistant to the distance from the point half way between the center of the object ball and the edge of the object ball. Because this is a point in space, this point can only be estimated. But, by using a ball made from concentric spheres, it will be easier to estimate this point since the ball's "halfway" point will be better delineated with a concentric sphere. And one only needs to transpose that distance to the other side of the ball edge. As before, any other fraction from ½ to 0 can theoretically be io reached using this method.

Another aiming method is called "Center to Edge" or CTE. Using this method, one targets the edge of the object ball, but places the tip of the cue one or two tips to the right or left of the cue ball center ball. The physics of this aiming method are beyond the scope of this disclosure, but since one only need accurately offset the tip of his/her cue from the center of the cue ball, this type of ball—made with concentric spheres—would lend itself well to this aiming method.

EXAMPLES

Each of the following exercises are designed to teach the player a particular technique or shot. The cue ball and object ball should be carefully aimed and aligned, in practice, such that the player may more easily differentiate between stroke effects and aiming inconsistencies. It is suggested that the player spend equal time mastering both the aiming and stroking techniques to follow. If the aim is straight and true, the system of the present invention will reveal any problems or variations in the stroke. Conversely, if the stroke is straight and true, the system will reveal any problems or variations in the aim. Stroking and aiming techniques therefore are alternated hereinafter to encourage the player to do the same while at the table.

In the following exercises, cue strokes are characterized as "soft," "medium," "hard," or "power." In this regard, the common industry standards regarding stroke power or speed relative to ball travel have been adopted as is shown in the table which follows:

Exercise—Effect of Spin on Position

Although squirt and curve are generally to be considered as necessary evils, spin can be a great ally in position play. To demonstrate the effect of spin on position, cue ball 10 may be set up and executed with a marker placed at where the ball 10 stops or hits the rail. The exercise may be repeated for at varying cue speeds, and from both the right and left side of cue ball 10. If the same spot on the cue ball is hit and the aim is proper, it will rebound off the rail at a consistent rebound angle for a given cue speed. In this way, the player may understand how just a little spin effects the rebound angle, especially with a soft cue stroke.

Exercise—Transfer of English

To understand the effects of what happens to an object ball when struck by a spinning cue ball, the latter may be positioned for striking with a cue stick so as to purposefully create a left OR right spinning cue and thereby transfer an intentional spin or english from the cue to the object ball the same as a thrown ball. This exercise may be repeated with varying degrees/levels of spin and power.

The transfer of spin has practical applications for bank shots in increasing the possible ways to make a shot by opening or shortening angles off the rail. The throw effect allows the player to increase or decrease the cut angle on a shot, while still pocketing the object ball, and thereby provides alternatives in position play. This "cheating" of the ball also affords the player a capability to make "close-but-impossible" shots such as when another object ball is slightly blocking what would be a "natural" center ball aiming. The spin can sometimes throw the ball far enough for it to be pocketed regardless.

Exercise—Follow and Draw

Before proceeding with the next two exercises, both follow and draw, it should be noted that mastery of two elements is essential for proper execution. Firstly, the cue ball must be struck at the proper location—upper for follow and lower for draw. Secondly, cue tip speed and a level cue are critical.

For practicing a follow shot, cue ball 10 should be placed with an object ball about 2 feet (61 cm) therefrom. The player begins by hitting medium speed shots just above the spot equivalent to two tips higher than center (or at about the intersection of the red and green spheres). Striking distances above center are then increased and the results noted for both harder and softer strokes. The distances between cue ball and object ball are increased, and the exercise is repeated. As before, the objective is for the player to learn how softly and how close to the center aiming point the cue ball may be struck while still achieving the desired follow effect.

For draw practicing, the balls are once more aligned for the shooter to aim and strike below the center point (rather than above it). The player may be amazed at the effect which may be achieved with only a relatively small degree of off-center hit but a relatively good stroke.

In summary, the practice ball system of the present invention as described in the preceding description and exercises will improve aiming techniques and the detail the effects of achieving spin, stun, follow, and draw. The system, advantageously, functions well in combining these effects, and the player is encouraged to practice them in combination such as high right or low left aiming points on the cue ball. With a little practice, the player will notice both an improved confidence and increased knowledge of the game. The practice cue ball of the present invention also may be utilized in conjunction with the playing of familiar pool games such as eight ball, nine ball, or straight or target pool.

It is anticipated that certain changes may be made in the apparatus and method described hereinbefore without departing from the scope of the invention herein involved. For example, the dimensions referred to herein relate to the standard size of American balls and cues. Other pool games, such as snooker, employ smaller balls and smaller cue tips such that measurement of all indicia would change proportionately for practice cue and object balls of the present invention intended for those games. Accordingly, it is intended that all matter contained in the foregoing description of the invention or shown in the accompanying drawings shall be interpreted as illustrative rather than in a limiting sense.

Accordingly, although the present invention has been described above in detail, the same is by way of illustration and example only and is not to be taken as a limitation on the present invention. For example, it is apparent to those having a level of ordinary skill in the relevant art that other variations and modifications in a pocket billiard practice ball system and method of aiming in the playing of pool and pocket billiards in accordance with the present invention, as described and shown herein, could be readily made using the teachings of the present invention. It is anticipated that certain embodiments may be made in other specific forms without departing from the spirit, essential characteristics or scope herein involved of the present invention. The preferred embodiment of the present invention disclosed herein is considered in all respects as illustrative and not restrictive, the scope of the invention being indicated by the appended claims rather than by the foregoing description and all changes which come within the meaning and range of the equivalency of the claims are therefore intended to be embraced therein. Accordingly, the scope and content of the present invention are to be defined only by the terms of the appended claims.

Having described the best modes currently known for practicing this axle replacement system and method, it is to be understood that the scope of this invention may be further described by the attached claims.

SEQUENCE LISTING

Not applicable.

What is claimed is:

1. A billiard ball for use in practicing and playing pool or billiards, said billiard ball comprising:

a centermost spherical ball made of an opaque material; and at least two spherical layers surrounding the centermost spherical ball, a first interior layer closest to the centermost spherical ball, said first interior layer being made from a semi-transparent polymer of a first tinted color and fully encasing the centermost spherical ball, an outermost exterior layer that fully encases the first interior layer and is made from a fully transparent polymer, at least one intermediate shell layer between the first interior layer and the fully transparent outermost exterior layer, said at least one intermediate shell layer being made from a semi-transparent polymer of a second tinted color visually distinguishable from the first tinted color of said first interior layer and fully encasing said first interior layer, said billiard ball being of regulation size and weight.

2. The billiard ball of claim 1, which is about 56 to 57 mm in diameter.

3. The billiard ball of claim 1, which is suitable for use as a cue ball and weighs about 0.17 kg.

4. The billiard ball of claim 1, which is suitable for use as one of a plurality of object balls against which a cue ball is aimed for striking, each of said plurality of object balls weighing about 0.16 kg.

5. The billiard ball of claim 1 wherein the centermost spherical ball has a diameter measuring between about 10 and 13 mm across.

6. The billiard ball of claim 1, which further includes: a second intermediate shell layer adjacent and fully encasing the first intermediate shell layer, said second intermediate shell layer being made from a semi-transparent polymer of a third tinted color visually distinguishable from the first tinted color of said first interior layer and the second tinted color of the first intermediate shell layer.

7. The billiard ball of claim 1 wherein the opaque material for the centermost ball consists essentially of lead.

8. The billiard ball of claim 1 wherein the opaque material is black, brown, dark blue or purple.

9. The billiard ball of claim 6 wherein the first tinted color for the first interior layer is selected from the group consisting of red, and blue, the second tinted color for the first intermediate shell layer is selected from the group consisting of green and orange; and the third tinted color for the second intermediate shell layer is selected from the group consisting of yellow and gray.

10. The billiard ball of claim 6, which includes a colored ball number indicator consistent with acceptable billiard standards of yellow for ball numbers 1 and 9, blue for ball numbers 2 and 10, red for ball numbers 3 and 11, purple for ball numbers 4 and 12, orange for ball numbers 5 and 13, green for ball numbers 6 and 14, maroon for ball numbers 7 and 15, and black for a ball numbered 8.

11. The billiard ball of claim 10 wherein balls numbered 9 through 15 further include at least one striped color region.

12. A cue ball for use in practicing and playing pool or billiards, said cue ball weighing about 0.17 kg and comprising:

a centermost black spherical ball having a diameter between about 11 to 16 mm;

a first interior shell layer made from a semi-transparent polymer of a first tinted color and fully encasing the centermost ball, said first interior shell layer being from about 11 to 13 mm thick between its innermost spherical surface adjacent the centermost ball and its outermost spherical surface, a combination of said centermost ball and said first interior shell layer having a total diameter between about 22 to 29 mm;

a second shell layer made from a semi-transparent polymer of a second tinted color and fully encasing the first interior shell layer, said second shell layer being from about 11 to 13 mm thick between its innermost spherical surface adjacent the first interior shell layer and its outermost spherical surface, a combination of said centermost ball, said first interior shell layer and said second shell layer having a total diameter between about 33 to 42 mm; and an outermost shell layer made from a fully transparent polymer and fully encasing the second shell layer, said outermost shell layer being from about 11 to 15 mm thick between its innermost spherical surface adjacent the second shell layer and its outermost spherical surface, a combination of said centermost ball, said first interior shell layer, said second shell layer and said outermost shell layer having a total diameter between about 44 to 57 mm.

13. The cue ball of claim 12 wherein the first tinted color for the first interior shell layer is selected from the group consisting of red and blue.

14. The cue ball of claim 12 wherein the second tinted color for the second shell layer is selected from the group consisting of green and orange.

15. A method for aligning, aiming and shooting in the practice and playing of pool or billiards on a billiard table, said method comprising the steps of:

(a) providing a cue ball having: (i) a centermost black spherical ball having a diameter between about 11 to 16 mm; (ii) a first interior shell layer made from a semi-transparent polymer of a first tinted color and fully encasing the centermost ball, said first interior shell layer being from about 11 to 13 mm thick between its innermost spherical surface adjacent the centermost ball and its outermost spherical surface, a combination of said centermost ball and said first interior shell layer having a total diameter between about 22 to 29 mm; (iii) a second shell layer made from a semi-transparent polymer of a second tinted color and fully encasing the first interior shell layer, said second shell layer being from about 11 to 13 mm thick between its innermost spherical surface adjacent the first interior shell layer and its outermost spherical surface, a combination of said centermost ball, said first interior shell layer and said second shell layer having a total diameter between about 33 to 42 mm; and (iv) an outermost shell layer made from a fully transparent polymer and fully encasing the second shell layer, said outermost shell layer being from about 11 to 15 mm thick between its innermost spherical surface adjacent the second shell layer and its outermost spherical surface, a combination of said centermost ball, said first interior shell layer, said second shell layer and said outermost shell layer having a total diameter between about 44 to 57 mm;

(b) orienting said cue ball in line with at least one of a plurality of object balls so as to have said cue ball strike a contact point on said one of a plurality of object balls at a desired speed, spin and angle; and (c) impacting said cue ball with a tip of a cue stick for moving said cue ball toward said contact point of said object ball along a playing surface of said billiard table.

16. The method of claim 15 wherein the cue ball can be used to align for practicing spin, stun, follow, and draw strikes against the object ball.

17. The method of claim 15 wherein the first tinted color for the first interior shell layer is selected from the group consisting of red and blue.

18. The method of claim 15 wherein the second tinted color for the second shell layer is selected from the group consisting of green and orange.

* * * * *